US005767046A

United States Patent [19]

Cusumano et al.

[11] Patent Number: 5,767,046

[45] Date of Patent: Jun. 16, 1998

[54] FUNCTIONALIZED ADDITIVES USEFUL IN TWO-CYCLE ENGINES

[75] Inventors: Joseph V. Cusumano, Watchung; William D. Diana, Belle Mead; William B. Eckstrom, Fanwood, all of N.J.; Jacob I. Emert, Brooklyn, N.Y.; Keith R. Gorda, Little York, N.J.; Michael J. Keenan, Baton Rouge, La.; Richard H. Schlosberg, Bridgewater, N.J.

[73] Assignee: Exxon Chemical Company, Linden, N.J.

[21] Appl. No.: 856,989

[22] Filed: May 15, 1997

Related U.S. Application Data

[63] Continuation of Ser. No. 615,573, Mar. 12, 1996, abandoned, which is a continuation of Ser. No. 261,558, Jun. 17, 1994, abandoned.

[51] Int. Cl.[6] ..... C10M 133/56; C10M 129/95

[52] U.S. Cl. ..... 508/443; 508/444; 508/463; 508/465; 508/551

[58] Field of Search ..... 508/443, 444, 508/463, 465, 551

[56] References Cited

U.S. PATENT DOCUMENTS

| | | | |
|---|---|---|---|
| Re. 26,433 | 8/1968 | Le Suer | 252/33.6 |
| 2,586,070 | 2/1952 | Luten, Jr. et al. | 260/624 |
| 2,831,877 | 4/1958 | Koch | 260/413 |
| 2,967,873 | 1/1961 | Koch et al. | 260/410.9 |
| 3,036,003 | 5/1962 | Verdol | 252/33.4 |
| 3,059,007 | 10/1962 | Vos et al. | 260/413 |
| 3,087,936 | 4/1963 | Le Suer | 260/326.3 |
| 3,135,716 | 6/1964 | Uraneck et al. | 260/45.5 |
| 3,167,585 | 1/1965 | Anderson et al. | 260/533 |
| 3,184,411 | 5/1965 | Lowe | 252/46.7 |
| 3,185,645 | 5/1965 | Clayton | 252/46.7 |
| 3,185,704 | 5/1965 | Kahn et al. | 260/326.3 |
| 3,200,107 | 8/1965 | Le Suer | 260/132 |
| 3,245,908 | 4/1966 | Lowe | 252/51.5 |
| 3,245,909 | 4/1966 | Lowe | 252/51.5 |
| 3,245,910 | 4/1966 | Lowe | 252/51.5 |
| 3,254,025 | 5/1966 | Le Suer | 252/32.7 |
| 3,256,185 | 6/1966 | Le Suer | 252/32.7 |
| 3,278,550 | 10/1966 | Norman et al. | 260/326.3 |
| 3,280,034 | 10/1966 | Anzenberger et al. | 252/51.5 |
| 3,281,428 | 10/1966 | Le Suer | 260/326.3 |
| 3,282,955 | 11/1966 | Le Suer | 260/326.3 |
| 3,284,410 | 11/1966 | Meinhardt | 252/49.6 |
| 3,306,908 | 2/1967 | Le Suer | 260/326.3 |
| 3,312,619 | 4/1967 | Vineyard | 252/47.5 |
| 3,331,776 | 7/1967 | Krukziener | 252/56 |
| 3,338,832 | 8/1967 | Le Suer | 252/47.5 |
| 3,344,069 | 9/1967 | Stuebe | 252/49.6 |
| 3,349,107 | 10/1967 | Pawlenko | 260/410.9 |
| 3,361,673 | 1/1968 | Stuart et al. | 252/51.5 |
| 3,366,569 | 1/1968 | Norman et al. | 252/51.5 |
| 3,367,943 | 2/1968 | Miller et al. | 260/326.3 |
| 3,369,021 | 2/1968 | Le Suer | 260/268 |
| 3,373,111 | 3/1968 | Le Suer et al. | 252/51.5 |
| 3,381,022 | 4/1968 | Le Suer | 260/404.8 |
| 3,390,086 | 6/1968 | O'Halloran | 252/47.5 |
| 3,401,118 | 9/1968 | Benoit, Jr. | 252/51.5 |
| 3,403,102 | 9/1968 | Le Suer | 252/49.8 |
| 3,415,750 | 12/1968 | Anzenberger | 252/51.5 |
| 3,428,561 | 2/1969 | Le Suer | 252/32.5 |
| 3,442,808 | 5/1969 | Traise et al. | 252/49.6 |
| 3,445,441 | 5/1969 | Rushton | 260/89.5 |
| 3,455,832 | 7/1969 | Davis | 252/51.5 |
| 3,458,530 | 7/1969 | Siegel et al. | 260/326.5 |
| 3,470,098 | 9/1969 | O'Halloran | 252/47.5 |
| 3,493,520 | 2/1970 | Verdol et al. | 252/51.5 |
| 3,502,677 | 3/1970 | Le Suer | 260/268 |
| 3,513,093 | 5/1970 | Le Suer | 252/32.5 |
| 3,522,179 | 7/1970 | Le Suer | 252/51.5 |
| 3,527,779 | 9/1970 | Paulis et al. | 260/413 |
| 3,533,945 | 10/1970 | Vogel | 252/49.6 |
| 3,539,633 | 11/1970 | Piasek et al. | 260/570.5 |
| 3,539,654 | 11/1970 | Pautrat et al. | 260/768 |
| 3,541,012 | 11/1970 | Stuebe | 252/51.5 |
| 3,542,680 | 11/1970 | Le Suer | 252/57 |
| 3,551,466 | 12/1970 | Gee et al. | 260/429 |
| 3,558,743 | 1/1971 | Verdol et al. | 260/848 |
| 3,573,205 | 3/1971 | Lowe et al. | 252/51.5 |
| 3,579,450 | 5/1971 | Le Suer | 252/56 |
| 3,595,942 | 7/1971 | Wald et al. | 260/880 |
| 3,600,372 | 8/1971 | Udelbefon | 260/132 |
| 3,639,242 | 2/1972 | Le Suer | 252/56 R |
| 3,649,659 | 3/1972 | Otto et al. | 260/429 R |
| 3,652,616 | 3/1972 | Watson et al. | 260/429 R |
| 3,681,415 | 8/1972 | Schell | 260/410.9 R |
| 3,692,681 | 9/1972 | Liston | 252/51.5 A |
| 3,697,428 | 10/1972 | Meinhardt et al. | 252/56 D |
| 3,703,536 | 11/1972 | Piasek et al. | 260/462 R |
| 3,708,522 | 1/1973 | Le Suer | 260/485 G |
| 3,711,406 | 1/1973 | Lowe | 252/33.4 |
| 3,718,663 | 2/1973 | Piasek et al. | 260/326.3 |
| 3,749,695 | 7/1973 | de Vries | 252/47.5 |
| 3,755,169 | 8/1973 | Adams et al. | 252/35 |
| 3,795,615 | 3/1974 | Pappas et al. | 252/59 |
| 3,803,087 | 4/1974 | Vaughn | 260/47 |
| 3,859,318 | 1/1975 | Le Suer | 260/410.6 |
| 3,865,740 | 2/1975 | Goldschmidt | 252/46.7 |
| 3,865,813 | 2/1975 | Gergel | 260/239.3 R |
| 3,870,734 | 3/1975 | Onopchenko et al. | 260/413 |
| 3,903,003 | 9/1975 | Murphy et al. | 252/51.5 A |
| 3,910,963 | 10/1975 | Souma et al. | 252/56 S |
| 3,954,639 | 5/1976 | Liston | 252/47.5 |
| 3,972,243 | 8/1976 | Driscoll et al. | 508/551 |
| 3,992,423 | 11/1976 | Massie | 260/410.6 |
| 4,073,737 | 2/1978 | Elliott | 252/51.5 A |
| 4,088,588 | 5/1978 | Pecoraro | 252/51.5 A |
| 4,102,798 | 7/1978 | Ryer et al. | 252/51.5 A |
| 4,108,945 | 8/1978 | Fetters et al. | 260/880 B |
| 4,113,639 | 9/1978 | Lonstrup et al. | 252/51.5 A |
| 4,116,876 | 9/1978 | Brois et al. | 252/49.6 |
| 4,156,128 | 5/1979 | Craven | 219/523 |
| 4,224,232 | 9/1980 | Onopchenko et al. | 260/413 |
| 4,234,435 | 11/1980 | Meinhardt et al. | 252/51.5 A |
| 4,256,913 | 3/1981 | Jung et al. | 562/521 |
| 4,262,138 | 4/1981 | Gelbein | 560/233 |
| 4,312,965 | 1/1982 | Jachimowicz et al. | 525/378 |
| 4,323,698 | 4/1982 | Haag et al. | 560/233 |
| 4,518,798 | 5/1985 | Kramer et al. | 560/233 |
| 4,539,654 | 9/1985 | Deyer | 364/900 |
| 4,611,086 | 9/1986 | Gueguen et al. | 568/897 |
| 4,668,834 | 5/1987 | Rim et al. | 585/12 |
| 4,681,707 | 7/1987 | Alper et al. | 260/410.9 R |
| 4,704,427 | 11/1987 | Kitahara et al. | 524/531 |
| 4,717,755 | 1/1988 | Doi et al. | 525/333.7 |
| 4,797,219 | 1/1989 | Gutierrez et al. | 252/56 D |
| 4,798,873 | 1/1989 | Meurer et al. | 525/333.7 |
| 4,857,217 | 8/1989 | Gutierrez et al. | 252/47 |

| | | | |
|---|---|---|---|
| 4,866,135 | 9/1989 | Gutierrez et al. | 525/285 |
| 4,866,139 | 9/1989 | Gutierrez et al. | 525/333.7 |
| 4,866,140 | 9/1989 | Gutierrez et al. | 525/333.7 |
| 4,866,141 | 9/1989 | Gutierrez et al. | 525/333.7 |
| 4,866,142 | 9/1989 | Gutierrez et al. | 525/333.7 |
| 4,902,822 | 2/1990 | Drent | 560/233 |
| 4,906,394 | 3/1990 | Gutierrez et al. | 252/51.5 A |
| 4,927,892 | 5/1990 | Drent et al. | 525/340 |
| 4,929,689 | 5/1990 | Meurer et al. | 525/333.9 |
| 4,952,739 | 8/1990 | Chen | 585/18 |
| 4,956,107 | 9/1990 | Gutierrez et al. | 252/47 |
| 4,963,275 | 10/1990 | Gutierrez et al. | 252/47 |
| 4,980,422 | 12/1990 | Willis | 525/370 |
| 5,017,199 | 5/1991 | Etchepare | 55/57 |
| 5,017,299 | 5/1991 | Gutierrez et al. | 252/51.5 R |
| 5,049,294 | 9/1991 | Van Zon et al. | 252/51.5 A |
| 5,070,131 | 12/1991 | Rhodes et al. | 524/484 |
| 5,084,534 | 1/1992 | Welborn, Jr. et al. | 526/160 |
| 5,102,566 | 4/1992 | Fetterman, Jr. et al. | 252/32.7 E |
| 5,342,979 | 8/1994 | Mueller et al. | 554/206 |
| 5,627,259 | 5/1997 | Thaler et al. | 528/342 |
| 5,629,434 | 5/1997 | Cusumano et al. | 554/219 |
| 5,643,859 | 7/1997 | Gutierrez et al. | 508/443 |
| 5,646,332 | 7/1997 | Cusumano et al. | 560/204 |
| 5,650,536 | 7/1997 | Dankworth et al. | 560/204 |

FOREIGN PATENT DOCUMENTS

| | | |
|---|---|---|
| 0 129 368 A1 | 12/1984 | European Pat. Off. . |
| 0 148 592 A2 | 7/1985 | European Pat. Off. . |
| 0148592A3 | 7/1985 | European Pat. Off. . |
| 0313150A1 | 4/1989 | European Pat. Off. . |
| 0397276A3 | 11/1990 | European Pat. Off. . |
| 0 462 319 A1 | 12/1991 | European Pat. Off. . |
| 62-164645 | 1/1986 | Japan . |
| 62-192338 | 2/1986 | Japan . |
| 4-15240 | 5/1990 | Japan . |
| 51-41320 | 5/1990 | Japan . |
| 984409 | 2/1965 | United Kingdom . |
| 1085903 | 10/1967 | United Kingdom . |
| 1162436 | 8/1969 | United Kingdom . |
| 1188900 | 4/1970 | United Kingdom . |

OTHER PUBLICATIONS

"Macromolecules", vol. 29, No. 5, 1996, p. 1785. (no month).

M. Beller et al., Journal of Molecular Catalysis, A:104 (1995) 17–85, p. 53. (no month).

Billmeyer, J.R., Textbook of Polymer Sciences, 2nd Edition, J. Wiley, pp. 3–21 (1971).

N. Bahrmann, Chapter 5, Koch Reactions, "New Syntheses with Carbon Monoxide", Edited by J. Falbe; Springer–Verlag, New York, New York 1980.

Y. Komatsu et al., Maruzen Sekiyo Gihi 21, 51 (1976).

Ya Eidus et al., "Synthesis of Derivatives of Carboxylic Acids Under Acid Catalysis Conditions from Carbon Monoxide, Olefins, and Compounds being Acylated" Z. Org. Chem. 4 (3) 376 (1968).

Gushcin, et al., "Investigation of the Reaction of Ozone with Phenols", Neftekhimiya, vol. 12, (No. 3) 383 (1972).

Wender, I., Organic Synthesis via Metal Carbonyls, vol. 2, pp. 233–296.

Puzitskii et al., *Carbonylation of Olefins and Alcohols with Carbon Monoxide in the Presence of a Catalyst System: $BF_3H_2O$–Liquid $SO_2$*, Izvestiya Akademii Nauk SSSR, Seriya Khimicheskaya, No. 10, pp. 2331–2334, Oct. 1977.

Chemical Abstracts No. CA77 (12):76298p.

Chemischer Informationdienst 41 (1972) .

*Primary Examiner*—Ellen M. McAvoy
*Attorney, Agent, or Firm*—John J. Mahon

[57] ABSTRACT

A hydrocarbon composition functionalized via the Koch reaction which is the reaction product of at least one hydrocarbon having a number average molecular weight of less than 500 and at least one ethylenic double bond per molecule, with carbon monoxide and a nucleophilic trapping agent. The hydrocarbon is usefully functionalized and derivatized, producing, in particular, lubricants suitable for use in two-cycle engines.

7 Claims, No Drawings

FUNCTIONALIZED ADDITIVES USEFUL IN TWO-CYCLE ENGINES

This is a continuation of application Ser. No. 08/615,573, filed Mar. 12, 1996, now abandoned, which is a continuation of application Ser. No. 08/261,558 filed Jun. 17, 1994, now abandoned.

FIELD OF THE INVENTION

The present invention is directed to an improved hydrocarbon or low molecular weight polymer functionalized by the Koch reaction. More particularly, it is directed to reacting at least one carbon-carbon double bond present in a hydrocarbon or low molecular weight polymer with carbon monoxide in the presence of an acidic catalyst and a nucleophilic trapping agent to form a carbonyl or thiocarbonyl functional group, and derivatives thereof.

The term "hydrocarbon" is used herein to refer to both non polymeric compounds comprising hydrogen and carbon as well as materials comprising large molecules built up by the repetition of small, simple chemical units. When only several such units are linked, the resulting composition is sometimes referred to as an oligomer, whereas the linking of many units is typically referred to as a polymer; there is no "bright line" distinguishing oligomers and low molecular weight polymers. In a hydrocarbon polymer those units are predominantly formed of hydrogen and carbon. Nonpolymeric compounds typically have uniform properties such as molecular weight, whereas polymers are defined by average properties; for example, number average molecular weight (Mn), although this term can be applied to both polymeric and nonpolymeric compositions. The term hydrocarbon is not intended to exclude mixtures of such compounds which individually are characterized by uniform properties.

Such hydrocarbon compounds have been reacted to form carboxyl group-containing compounds and their derivatives. Carboxyl groups have the general formula —CO—OR, where R can be H, a hydrocarbyl group, or a substituted hydrocarbyl group.

BACKGROUND OF THE INVENTION

The synthesis of carboxyl group-containing compounds from olefinic hydrocarbon compounds, carbon monoxide, and water in the presence of metal carboxyls is disclosed in references such as N. Bahrmann, Chapter 5, Koch Reactions, "New Synthesis with Carbon Monoxide" J. Falbe; Springer-Verlag, New York, 1980. Hydrocarbons having olefinic double bonds react in two steps to form carboxylic acid-containing compounds. In the first step an olefin compound reacts with an acid catalyst and carbon monoxide in the absence of water. This is followed by a second step in which the intermediate formed during the first step undergoes hydrolysis or alcoholysis to form a carboxylic acid or ester. An advantage of the Koch reaction is that it can occur at moderate temperatures of −20° C. to +80° C., and pressures up to 100 bar.

The Koch reaction can occur at double bonds where at least one carbon of the double bond is di-substituted to form a "neo" acid or ester:

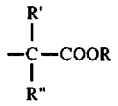

The Koch reaction can also occur when both carbons are mono-substituted or one is monosubstituted and one is unsubstituted to form an "iso" acid (i.e. —R'HC—COOR). Bahrmann et al. discloses isobutylene converted to isobutyric acid via a Koch-type reaction.

U.S. Pat. No. 2,831,877 discloses a multi-phase, acid catalyzed, two-step process for the carboxylation of olefins with carbon monoxide.

Complexes of mineral acids in water with $BF_3$ have been studied to carboxylate olefins. U.S. Pat. No. 3,349,107 discloses processes which use less than a stoichiometric amount of acid as a catalyst. Examples of such complexes are $H_2O.BF_3.H_2O$, $H_3PO_4.BF_3.H_2O$ and $HF.BF_3.H_2O$.

EP-A-0148592 relates to the production of carboxylic acid esters and/or carboxylic acids by catalyzed reaction of a polymer having carbon-carbon double bonds, carbon monoxide and either water or an alcohol, optionally in the presence of oxygen. The catalysts are metals such as palladium, rhodium, ruthenium, iridium, and cobalt in combination with a copper compound, in the presence of a protonic acid such as hydrochloric acid. A preferred polymer is polyisobutene, which may have at least 80% of its carbon-carbon double bonds in the form of terminal double bonds. Liquid polyisobutene having a number average molecular weight in the range of from 200 to 2,500, preferably up to 1,000 are described.

U.S. Pat. No. 4,927,892 relates to reacting a polymer or copolymer of a conjugated diene, at least part of which is formed by 1,2 polymerization, with carbon monoxide and water and/or alcohol in the presence of a catalyst prepared by combining a palladium compound, certain ligands and/or acid except hydrohalogenic acids having a pKa of less than 2. Useful Lewis acids include $BF_3$.

Although there are disclosures in the art of olefinic hydrocarbons functionalized at the carbon-carbon double bond to form a carboxylic acid or derivative thereof via Koch-type chemistry, there is no disclosure that polymers containing carbon-carbon double bonds, including terminal olefinic bonds, either secondary or tertiary type olefinic bonds, could be successfully reacted via the Koch mechanism. Furthermore, the adances achieved herein utilizing specific classes of useful reactants are previously unknown. Additionally, it has been found that the process of the present invention is particularly useful to make neo acid and neo ester functionalized hydrocarbons and polymers. Known catalysts used to carboxylate low molecular weight olefinic hydrocarbons by the Koch mechanism were found to be unsuitable for use with polymeric material. Specific catalysts have been found which can result in the formation of a carboxylic acid or ester at a carbon-carbon double bond of a polymer. Koch chemistry affords the advantage of the use of moderate temperatures and pressures, by using highly acidic catalysts and/or careful control of concentrations.

U.S. patent application Ser. No. 261,507, Attorney Docket Number PT-1143, Amidation of Ester Functionalized Polymers, now abandoned; U.S. patent application Ser. No. 261,557, Attorney Docket Number PT-1144, Prestripped Polymer Used to Improve Koch Reaction Dispersant Additives, now abandoned; U.S. patent appication Ser. No. 261,559, Attorney Docket Number PT-1145, Batch Koch Carbonylation Process, now U.S. Pat. No. 5,646,332; U.S. patent application Ser. No. 261,534, Attorney Docket Number PT-1146, Derivatives of Polyamines With One Primary Amine and Secondary or Tertiary Amines, now U.S. Pat. No. 5,643,859; U.S. patent application Ser. No. 261,560, Attorney Docket Number PT-1149, Continuous Process for Production of Functionalized Olefins, now U.S. Pat. No. 5,650,536; and U.S. patent application Ser. No. 261,554, Attorney Docket Number PT-1150, Lubricating Oil Dispersants Derived from Heavy Polyamines; all filed Jun. 17, 1994, all contain related subject matter as indicated by their titles and are hereby incorporated by reference in their entirety for all purposes.

SUMMARY OF THE INVENTION

A functionalized hydrocarbon of less than 500 Mn wherein functionalization comprises at least one group of the formula —CO—Y—$R^3$ wherein Y is O or S; $R^3$ is aryl, substituted aryl or substituted hydrocarbyl; and —Y—$R^3$ has a pKa of 12 or less and wherein at least 50 mole % of the functional groups are attached to a tertiary carbon atom; and a process for producing such functionalized hydrocarbon.

Also disclosed are derivatized hydrocarbon dispersants which are the product of reacting (1) a functionalized hydrocarbon of less than 500 Mn wherein functionalization comprises at least one group of the formula —CO—Y—$R^3$ wherein Y is O or S; $R^3$ is H, hydrocarbyl, aryl, substituted aryl or substituted hydrocarbyl and wherein at least 50 mole % of the functional groups are attached to a tertiary carbon atom; and (2) a nucleophilic reactant; wherein at least about 80% of the functional groups originally present in the functionalized hydrocarbon are derivatized.

In particular there are disclosed lubricant compositions suitable for use in two-cycle engines and lubricant fuel mixtures for such use, comprising a major amount of at least one oil of lubricating viscosity and a minor amount of a functionalized and derivatized hydrocarbon; wherein functionalization comprises at least one group of the formula —CO—Y—$R^3$ wherein Y is O or S; $R^3$ is aryl, substituted aryl or substituted hydrocarbyl and —Y—$R^3$ has a pKa of 12 or less; wherein at least 50 mole % of said functional groups are attached to a tertiary carbon atom; and wherein the functionalized hydrocarbon is derivatized by a nucleophilic reactant.

DETAILED DESCRIPTION

The present invention relates to a functionalized hydrocarbon, particularly wherein the the hydrocarbon is an oligomer or polymer with a molecular weight (Mn) of less than 500, and functionalization is by groups of the formula:

$$—CO—Y—R^3$$

wherein Y is O or S, and either $R^3$ is H, hydrocarbyl and at least 50 mole % of the functional groups are attached to a tertiary carbon atom of the polymer backbone or $R^3$ is aryl, substituted aryl or substituted hydrocarbyl and the —Y—$R^3$ moiety has a pKa value of 12 or less.

Thus the functionalized hydrocarbon or polymer may be depicted by the formula:

$$POLY—(CR^1R^2—CO—Y—R^3)_n \quad (I)$$

wherein POLY is a hydrocarbon, including an oligomer or polymer backbone having a number average molecular weight of less than 500, n is a number greater than 0, $R^1$, $R^2$ and $R^3$ may be the same or different and are each H, hydrocarbyl with the proviso that either $R^1$ and $R^2$ are selected such that at least 50 mole percent of the —$CR^1R^2$ groups wherein both $R^1$ and $R^2$ are not H, or $R^3$ is aryl substituted aryl or substituted hydrocarbyl.

When a carbon of the carbon-carbon double bond is substituted with hydrogen, it will result in an "iso" functional group, i.e. one of $R^1$ or $R^2$ of Formula I is H; or when a carbon of the double bond is fully substituted with hydrocarbyl groups it will result in an "neo" functional group, i.e. both $R^1$ or $R^2$ of Formula I are non-hydrogen groups.

As used herein the term "hydrocarbyl" denotes a group having a carbon atom directly attached to the remainder of the molecule and having predominantly hydrocarbon character within the context of this invention and includes polymeric hydrocarbyl radicals. Such radicals include the following:

(1) Hydrocarbon groups; that is, aliphatic, (e.g., alkyl or alkenyl), alicyclic (e.g., cycloalkyl or cycloalkenyl), aromatic, aliphatic- and alicyclic-substituted aromatic, aromatic-substituted aliphatic and alicyclic radicals, and the like, as well as cyclic radicals wherein the ring is completed through another portion of the molecule (that is, the two indicated substituents may together form a cyclic radical). Such radicals are known to those skilled in the art; examples include methyl, ethyl, butyl, hexyl, octyl, decyl, dodecyl, tetradecyl, octadecyl, eicosyl, cyclohexyl, phenyl and naphthyl (all isomers being included).

(2) Substituted hydrocarbon groups; that is, radicals containing non-hydrocarbon substituents which, in the context of this invention, do not alter predominantly hydrocarbon character of the radical. Those skilled in the art will be aware of suitable substituents (e.g., halo, hydroxy, alkoxy, carbalkoxy, nitro, alkylsulfoxy).

(3) Hetero groups; that is, radicals which, while predominantly hydrocarbon in character within the context of this invention, contain atoms other than carbon present in a chain or ring otherwise composed of carbon atoms. Suitable hetero atoms will be apparent to those skilled in the art and include, for example, nitrogen, particularly non-basic nitrogen, which would otherwise deactivate the Koch catalyst, oxygen and sulfur.

In general, no more than about three substituents or hetero atoms, and preferably no more than one, will be present for each 10 carbon atoms in the hydrocarbon-based radical.

Polymeric hydrocarbyl radicals are those derived from hydrocarbon polymers, which may be substituted and/or contain hetero atoms provided that they remain predominantly hydrocarbon in character.

The functionalized hydrocarbon may be derived from a hydrocarbon or hydrocarbon polymer comprising non-aromatic carbon-carbon double bond, also referred to as an olefinically unsaturated bond, or an ethylenic double bond. The hydrocarbon is functionalized at that double bond via a Koch reaction to form the carboxylic acid, carboxylic ester or thio acid or thio ester.

In the Koch process as practiced herein, a hydrocarbon or low molecular weight hydrocarbon polymer having at least one ethylenic double bond is contacted with an acid catalyst and carbon monoxide in the presence of a nucleophilic trapping agent such as water or alcohol. The catalyst is preferably a classical Bronsted acid or Lewis acid catalyst. These catalysts are distinguishable from the transition metal catalysts of the type described in the prior art. The Koch reaction, as applied in the process of the present invention, can result in good yields of functionalized polymer, even 90 mole % or greater.

POLY, in general formula I, represents a hydrocarbon polymer backbone having Mn of less than 500. Mn may be determined by well known available techniques such as gel permeation chromatography (GPC) and vapor pressure osmometry. POLY is derived from unsaturated polymer.

Hydrocarbons and Polymers

The hydrocarbons and polymers which are useful in the present invention contain at least one carbon-carbon double bond (olefinic or ethylenic unsaturation). Thus, the maximum number of functional groups per molecule (e.g., per polymer chain) is limited by the number of double bonds per molecule. Such hydrocarbons have been found to be receptive to Koch mechanisms to form carboxylic acids or derivatives thereof, using the catalysts and nucleophilic trapping agents of the present invention.

Useful hydrocarbons in the present invention include polyalkenes including homopolymer, copolymer (used interchangeably with interpolymer) and mixtures. Homopolymers and interpolymers include those derived from polymerizable olefin monomers of 2 to about 16 carbon atoms; usually 2 to about 6 carbon atoms. Particular reference is made to the alpha olefin polymers made using organo metallic coordination compounds. A particularly preferred class of polymers are ethylene alpha olefin copolymers such as those disclosed in U.S. Pat. No. 5,017,299. The polymer unsaturation can be terminal, internal or both. Preferred polymers have terminal unsaturation, preferably a high degree of terminal unsaturation. Terminal unsaturation is the unsaturation provided by the last monomer unit located in the polymer molecule. The unsaturation can be located anywhere in this terminal monomer unit. Terminal olefinic groups include vinylidene unsaturation, $R^aR^bC{=}CH^2$; trisubstituted olefin unsaturation, $R^aR^bC{=}CR^cH$; vinyl unsaturation, $R^aHC{=}CH_2$; 1,2-disubstituted terminal unsaturation, $R^aHC{=}CHR^b$; and tetra-substituted terminal unsaturation, $R^aR^bC{=}CR^cR$. At least one of $R^a$ and $R^b$ is a polymeric group of the present invention, and the remaining $R^b$, $R^c$ and $R^d$ are hydrocarbon groups as defined with respect to R, $R^1$, $R^2$, and $R^3$ above. The values of the ratio Mw/Mn, referred to as molecular weight distribution (MWD), are not critical. However, a typical minimum Mw/Mn value of about 1.1–2.0 is preferred with typical ranges of about 1.1 up to about 4.

The olefin monomers are preferably polymerizable terminal olefins; that is, olefins characterized by the presence in their structure of the group —R—C=$CH_2$, where R is H or a hydrocarbon group. However, polymerizable internal olefin monomers (sometimes referred to in the patent literature as medial olefins) characterized by the presence within their structure of the group:

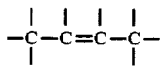

can also be used to form the polyalkenes. When internal olefin monomers are employed, they normally will be employed with terminal olefins to produce polyalkenes which are interpolymers. For this invention, a particular polymerized olefin monomer which can be classified as both a terminal olefin and an internal olefin, will be deemed a terminal olefin. Thus, pentadiene-1,3 (i.e., piperylene) is deemed to be a terminal olefin.

While the polyalkenes generally are hydrocarbon polyalkenes, they can contain substituted hydrocarbon groups such as lower alkoxy, lower alkyl mercapto, hydroxy, mercapto, and carbonyl, provided the non-hydrocarbon moieties do not substantially interfere with the functionalization or derivatization reactions of this invention. When present, such substituted hydrocarbon groups normally will not contribute more than about 10% by weight of the total weight of the polyalkenes. Since the polyalkene can contain such non-hydrocarbon substituent, it is apparent that the olefin monomers from which the polyalkenes are made can also contain such substituents. As used herein, the term "lower" when used with a chemical group such as in "lower alkyl" or "lower alkoxy" is intended to describe groups having up to seven carbon atoms.

The polyalkenes may include aromatic groups and cycloaliphatic groups such as would be obtained from polymerizable cyclic olefins or cycloaliphatic substituted-polymerizable acrylic olefins. There is a general preference for polyalkenes free from aromatic and cycloaliphatic groups (other than the diene styrene interpolymer exception already noted). There is a further preference for polyalkenes derived from homopolymers and interpolymers of terminal hydrocarbon olefins of 2 to 16 carbon atoms. This further preference is qualified by the proviso that, while interpolymers of terminal olefins are usually preferred, interpolymers optionally containing up to about 40% of polymer units derived from internal olefins of up to about 16 carbon atoms are also within a preferred group. A more preferred class of polyalkenes are those selected from the group consisting of homopolymers and interpolymers of terminal olefins of 2 to 6 carbon atoms, more preferably 2 to 4 carbon atoms. However, another preferred class of polyalkenes are the latter, more preferred polyalkenes optionally containing up to about 25% of polymer units derived from internal olefins of up to about 6 carbon atoms.

Specific examples of terminal and internal olefin monomers which can be used to prepare the polyalkenes according to conventional, well-known polymerization techniques include ethylene; propylene; butene-1; butene-2; isobutene; pentene-1; etc.; propylene-tetramer; diisobutylene; isobutylene trimer; butadiene-1,2; butadiene-1,3; pentadiene-1,2; pentadiene-1,3; etc.

Useful polymers include alpha-olefin homopolymers and interpolymers, and ethylene alpha-olefin copolymers and terpolymers (particularly wherein the third monomer is a nonconjugated diene such as dicyclopentadiene, 1,4-hexadiene and ethylidene norbornene, as well as others as are well known in the art). Specific examples of polyalkenes include polypropylenes, polybutenes, ethylene-propylene copolymers, ethylene-butene copolymers and terpolymers utilizing the above-noted nonconjugated dienes, propylene-butene copolymers, styrene-isobutene copolymers, isobutene-butadiene-1,3 copolymers, etc., and terpolymers of isobutene, styrene and piperylene and copolymer of 80% of ethylene and 20% of propylene. A useful source of polyalkenes are the poly(isobutene)s obtained by polymerization of $C_4$ refinery stream having a butene content of about 35 to about 75% by wt., and an isobutene content of about 30 to about 60% by wt., in the presence of a Lewis acid catalyst such as aluminum trichloride or boron trifluoride. A preferred source of monomer for making poly-n-butenes is petroleum feedstreams such as Raffinate II. These feedstocks are disclosed in the art, e.g., U.S. Pat. No. 4,952,739.

Ethylene Alpha-Olefin Copolymer

Preferred polymers are polymers of ethylene and at least one alpha-olefin having the formula $H_2C{=}CHR^4$ wherein $R^4$ is straight chain or branched chain alkyl radical comprising 1 to 18 carbon atoms and wherein the polymer contains a high degree of terminal ethenylidene unsaturation. Preferably $R^4$ in the above formula is alkyl of from 1 to 8 carbon atoms and more preferably is alkyl of from 1 to 2 carbon atoms. Therefore, useful comonomers with ethylene in this invention include propylene, 1-butene, hexene-1, octene-1, etc., and mixtures thereof (e.g. mixtures of propylene and 1-butene, and the like). Preferred polymers are copolymers of ethylene and propylene and ethylene and butene-1 with or without limited amounts (e.g., less than 15 weight %) of nonconjugated diene, as described above.

The molar ethylene content of the polymers employed is preferably in the range of between about 20 and about 80%, and more preferably between about 30 and about 70%. When butene-1 is employed as comonomer with ethylene, the ethylene content of such copolymer is most preferably between about 20 and about 45 wt %, although higher or lower ethylene contents may be present. The most preferred ethylene-butene-1 copolymers are disclosed in U.S. patent appication Ser. No. 992,192, filed Dec. 17, 1992; the preferred method for making low molecular weight ethylene/α-olefin copolymer is described in U.S. patent application Ser. No. 992,690, filed Dec. 17, 1992. The polymers useful in the present invention preferably exhibit a degree of crystallinity such that, when grafted, they are essentially amorphous.

The preferred ethylene alpha-olefin polymers are further characterized in that up to about 95% and more of the polymer chains possess terminal vinylidene-type unsaturation. Thus, one end of such polymers will be of the formula POLY—$C(R^{11})$=$CH_2$ wherein $R^{11}$ is $C_1$ to $C_{18}$ alkyl, preferably $C_1$ to $C_8$ alkyl, and more preferably methyl or ethyl and wherein POLY represents the polymer chain. A minor amount of the polymer chains can contain terminal ethenyl unsaturation, i.e. POLY—CH=$CH_2$, and a portion of the polymers can contain internal monounsaturation, e.g. POLY—CH=$CH(R^{11})$, wherein $R^{11}$ is as defined above. The preferred ethylene alpha-olefin polymer comprises polymer chains, at least about 30% of which possess terminal vinylidene unsaturation. Preferably at least about 50%, more preferably at least about 60%, and most preferably at least about 75% (e.g. 75 to 98%), of such polymer chains exhibit terminal vinylidene unsaturation. The percentage of polymer chains exhibiting terminal vinylidene unsaturation may be determined by FTIR spectroscopic analysis, titration, HNMR, or $C_{13}$NMR.

The polymers can be prepared by polymerizing monomer mixtures comprising ethylene with other monomers such as alpha-olefins, preferably from 3 to 4 carbon atoms in the presence of a metallocene catalyst system comprising at least one metallocene (e.g., a cyclopentadienyl-transition metal compound) and an activator, e.g. alumoxane compound. The comonomer content can be controlled through selection of the metallocene catalyst component and by controlling partial pressure of the monomers.

The polymer for use in the present invention can include block and tapered copolymers derived from monomers comprising at least one conjugated diene with at least monovinyl aromatic monomer, preferably styrene. Such polymers should not be completely hydrogenated so that the polymeric composition contains olefinic double bonds, preferably at least one bond per molecule. The present invention can also include star polymers as disclosed in patents such as U.S. Pat. Nos. 5,070,131; 4,108,945; 3,711,406; and 5,049,294. In each instance where polymers or oligomers are employed, molecular weight (Mn) should be less than 500.

Referring to chemical formula I, above, the letter n is greater than O and represents the functionality (F) or average number of functional groups per polymer chain. Thus, functionality can be expressed as the average number of moles of functional groups per "mole of hydrocarbon or polymer". It is to be understood that the term "mole of hydrocarbon or polymer" includes both functionalized and unfunctionalized polymer, so that although F corresponds to n of Formula (I), the functionalized polymer will include molecules having no functional groups. Specific preferred embodiments of n include 1>n>0; 2>n>1; and n>2; n can be determined by $C^{13}$ NMR. The optimum number of functional groups needed for desired performance will typically increase with number average molecular weight of the polymer. The maximum value of n will be determined by the number of double bonds per polymer chain or molecule in the unfunctionalized hydrocarbon or polymer.

In specific and preferred embodiments the "leaving group" (—$YR^3$) has a pKa of less than or equal to 12, preferably less than 10, and more preferably less than 8. The pKa is determined from the corresponding acidic species HY—$R^3$ in water at room temperature. Where the leaving group is a simple acid or alkyl ester, the functionalized hydrocarbon or polymer is very stable, especially as the % neo substitution increases.

The present invention is especially useful to make "neo" functionalized polymer which are generally more stable and labile than "iso" structures. In preferred embodiments the hydrocarbon can be at least 60, more preferably at least 80 mole percent neofunctionalized. The polymer can be greater than 90, or 99 and even about 100 mole percent neo.

In one preferred composition, the polymer defined by formula (I), Y is O (oxygen), $R^1$ and $R^2$ can be the same or different and are selected from H, a hydrocarbyl group, and a polymeric group. In another preferred embodiment Y is O or S, $R^1$ and $R^2$ can be the same or different and are selected from H, a hydrocarbyl group a substituted hydrocarbyl group and a polymeric group, and $R^3$ is selected from a substituted hydrocarbyl group, an aromatic group and a substituted aromatic group. This embodiment is generally more reactive towards derivatization with amines and alcohol compounds especially where the $R^3$ substituent contains electron withdrawing species. It has been found that in this embodiment, a preferred leaving group, $HYR^3$, has a pKa of less than 12, preferably less than 10 and more preferably 8 or less. pKa values can range typically from 5 to 12, preferably from 6 to 10, and most preferably from 6 to 8. The pKa of the leaving group determines how readily the system will react with derivatizing compounds to produce derivatized product.

In a particularly preferred composition, $R^3$ is represented by the formula:

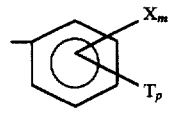

wherein X, which may be the same or different, is an electron withdrawing substituent, T, which may be the same or different, represents a non-electron withdrawing substituent (e.g. electron donating), and m and p are from 0 to 5 with the sum of m and p being from 0 to 5. More preferably, m is from 1 to 5 and preferably 1 to 3. In a particularly preferred embodiment X is selected from a halogen, preferably F or Cl, $CF_3$, cyano groups and nitro groups and p=0. A preferred $R^3$ is derived from 2,4-dichlorophenol.

The composition of the present invention includes derivatized hydrocarbon or polymer which is the reaction product of the Koch functionalized polymer and a derivatizing compound. Preferred derivatizing compounds include nucleophilic reactant compounds including amines, alcohols, amino-alcohols, metal reactant compounds and mixtures thereof. Derivatized hydrocarbon or polymer will typically contain at least one of the following groups: amide, imide, oxazoline, and ester, and metal salt. The suitability for a particular end use may be improved by appropriate selection of the molecular weight and functionality used in the derivatized hydrocarbon or polymer as discussed hereinafter.

As practiced herein, the Koch reaction permits controlled functionalization of unsaturated hydrocarbons. As described above when a carbon of the carbon-carbon double bond is substituted with hydrogen, it will result in an "iso" functional group, i.e. one of $R^1$ or $R^2$ of Formula I is H; or when a carbon of the double bond is fully substituted with hydrocarbyl groups it will result in an "neo" functional group, i.e. both $R^1$ or $R^2$ of Formula I are non-hydrogen groups.

Hydrocarbons, which include hydrocarbon polymers produced by processes which result in a terminally unsaturated polymer chain, can be functionalized to a relatively high yield in accordance with the process of the present invention. It has been found that the neo acid functionalized polymer can be derivatized to a relatively high yield.

The Koch process also makes use of relatively inexpensive materials, i.e., carbon monoxide, at relatively low temperatures and pressures. Also the leaving group $—YR^3$ can be removed and recycled upon derivatizing the Koch functionalized hydrocarbon with, e.g., amines or alcohols.

The functionalized or derivatized polymers of the present invention are useful as lubricant additives such as dispersants. The present invention includes oleaginous compositions comprising the above functionalized, and/or derivatized hydrocarbon. Such compositions include lubricating oil compositions and concentrates and fuels containing such lubricants.

The invention also provides a process which comprises the step of catalytically reacting in admixture:

(a) at least one hydrocarbon or hydrocarbon polymer having a number average molecular weight of less than 500, and an average of at least one ethylenic double bond per polymer chain;

(b) carbon monoxide, (c) at least one acid catalyst, and (d) a nucleophilic trapping agent selected from the group consisting of hydroxy-containing compounds and thiol-containing compounds, the reaction being conducted a) in the absence of reliance on transition metal as a catalyst; or b) with at least one acid catalyst having a Hammett acidity of less than −7; or c) wherein functional groups are formed at least 40 mole % of the ethylenic double bonds; or d) wherein the nucleophilic trapping agent has a pKa of less than 12.

The process of the present invention relates to a hydrocarbon or polymer having at least one ethylenic double bond reacted via a Koch mechanism to form carbonyl or thio carbonyl group-containing compounds, which may subsequently be derivatized. The hydrocarbons react with carbon monoxide in the presence of an acid catalyst or a catalyst preferably complexed with the nucleophilic trapping agent. A preferred catalyst is $BF_3$ and preferred catalyst complexes include $BF_3 \cdot H_2O$ and $BF_3$ complexed with 2,4-dichlorophenol. The starting polymer reacts with carbon monoxide at points of unsaturation to form either iso- or neo- acyl groups with the nucleophilic trapping agent, e.g. with alcohol (preferably a substituted phenol) or thiol to form respectively a carboxylic acid, carboxylic ester group, or thio ester.

In a preferred process, at least one hydrocarbon or polymer having at least one carbon-carbon double bond is contacted with an acid catalyst or catalyst complex having a Hammett Scale acidity value of less than −7, preferably from −8.0 to −11.5 and most preferably from −10 to −11.5. Without wishing to be bound by any particular theory, it is believed that a carbenium ion may form at the site of one of carbon-carbon double bonds. The carbenium ion may then react with carbon monoxide to form an acylium cation. The acylium cation may react with at least one nucleophilic trapping agent as defined herein.

At least 40 mole %, preferably at least 50 mole %, more preferably at least 80 mole %, and most preferably 90 mole % of the polymer double bonds will react to form acyl groups wherein the non-carboxyl portion of the acyl group is determined by the identity of the nucleophilic trapping agent, i.e. water forms acid, alcohol forms acid ester and thiol forms thio ester. The hydrocarbon or polymer functionalized by the recited process of the present invention can be isolated using fluoride salts. The fluoride salt can be selected from the group consisting of ammonium fluoride, and sodium fluoride.

Preferred nucleophilic trapping agents are selected from the group consisting of monohydric alcohols, polyhydric alcohols hydroxyl-containing aromatic compounds and hetero substituted phenolic compounds. The catalyst and nucleophilic trapping agent can be added separately or combined to form a catalytic complex.

Following is an example of a reaction sequence for a terminally unsaturated polymer reacted via the Koch mechanism to form an acid or an ester. The polymer is contacted with carbon monoxide or a suitable carbon monoxide source such as formic acid in the presence of an acidic catalyst. The catalyst contributes a proton to the carbon-carbon double bond to form a carbenium ion. This is followed by addition of CO to form an acylium ion which reacts with the nucleophilic trapping agent. POLY, Y, $R^1$, $R^2$ and $R^3$ are defined as above.

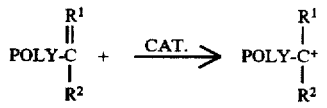

(II)

(carbenium ion)

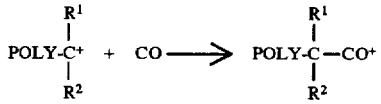

(III)

(acylium ion)

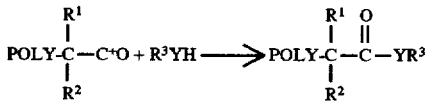

(IV)

The Koch reaction is particularly useful to functionalize poly(alpha olefins) and ethylene alpha olefin copolymers formed using metallocene-type catalysts. These polymers contain terminal vinylidene groups. There is a tendency for such terminal groups to predominate and result in neo-type (tertiary) carbenium ions. In order for the carbenium ion to form, the acid catalyst is preferably relatively strong. However, the strength of the acid catalyst is preferably balanced against detrimental side reactions which can occur when th e acid is too strong.

The Koch catalyst can be employed by preforming a catalyst complex with the proposed nucleophilic trapping agent or by adding the catalyst and trapping agent separately to the reaction mixture. This later embodiment has been found to be particularly advantageous since it eliminates the step of making the catalyst complex.

The following are examples of suitable acidic catalyst and catalyst complex materials with their respective Hammett Scale Value acidity: 60% $H_2SO_4$, −4.32; $BF_3 \cdot 3H_2O$, −4.5; $BF_3 \cdot 2H_2O$, −7.0; $WO_3/Al_2O_3$, less than −8.2; $SiO_2/Al_2O_3$, less than −8.2; HF, −10.2; $BF_3 \cdot H_2O$, −11.4; −11.94; $ZrO_2$ less than −12.7; $SiO_2/Al_2O_3$, −12.7 to −13.6; $AlCl_3$, −13.16 to −13.75; $AlCl_3/CuSO_4$, −13.75 to −14.52.

It has been found that $BF_3 \cdot 2H_2O$ is ineffective at functionalizing polymer through a Koch mechanism ion with polymers. In contrast, $BF_3 \cdot H_2O$ resulted in high yields of carboxylic acid for the same reaction. The use of $H_2SO_4$ as a catalyst involves control of the acid concentration to achieve the desired Hammett Scale Value range. Preferred catalysts are $H_2SO_4$ and $BF_3$ catalyst systems. Suitable $BF_3$ catalyst complexes for use in the present invention can be represented by the formula:

$$BF_3 \cdot xHOR$$

wherein R can represent hydrogen, hydrocarbyl (as defined below in connection with R') —CO—R', —$SO_2$—R', —PO—$(OH)_2$, and mixtures thereof wherein R' is hydrocarbyl, typically alkyl, e.g., $C_1$ to $C_{20}$ alkyl, and, e.g., $C_6$ to $C_{14}$ aryl, aralkyl, and alkaryl, and x is less than 2.

Following reaction with CO, the reaction mixture is further reacted with a nucleophilic trapping agent such as an alcohol or phenolic, or thiol compound. The use of hydroxy trapping agents releases the catalyst to form an ester, the use of a thiol releases the catalyst to form a thio ester.

Koch product, also referred to herein as functionalized hydrocarbon or polymer, typically will be derivatized as described hereinafter. Derivatization reactions involving ester functionalized polymer will typically have to displace the alcohol derived moiety therefrom. Consequently, the alcohol derived portion of the Koch functionalized polymer is sometimes referred to herein as a leaving group. The ease with which a leaving group is displaced during derivatization will depend on its acidity, i.e. the higher the acidity the more easily it will be displaced. The acidity in turn of the alcohol is expressed in terms of its pKa.

Preferred nucleophilic trapping agents include hydroxy group containing compounds. Useful hydroxy trapping agents include aliphatic compounds such as monohydric and polyhydric alcohols or aromatic compounds such as phenols and naphthols. The aromatic hydroxy compounds from which the esters of this invention may be derived are illustrated by the following specific example: phenol, -naphthol, cresol, resorcinol, catechol, 2-chlorophenol. Particularly preferred is 2,4-dichlorophenol.

The alcohols preferably can contain up to about 40 aliphatic carbon atoms. They may be monohydric alcohols such as methanol, ethanol, benzyl alcohol, 2-methylcyclohexanol, beta-chloroethanol, monomethyl ether of ethylene glycol, etc. The polyhydric alcohols preferably contain from 2 to about 5 hydroxy radicals; e.g., ethylene glycol, diethylene glycol. Other useful polyhydric alcohols include glycerol, monomethyl ether of glycerol, and pentaerythritol. Useful unsaturated alcohols include allyl alcohol, and propargyl alcohol.

Particularly preferred alcohols include those having the formula $R^*_2CHOH$ where an R* is independently hydrogen, an alkyl, aryl, hydroxyalkyl, or cycloalkyl. Specific alcohols include alkanols such as methanol, ethanol, etc. Also preferred useful alcohols include aromatic alcohols, phenolic compounds and polyhydric alcohols as well as monohydric alcohols such as 1,4-butanediol.

It has been found that neo-acid ester functionalized hydrocarbon or polymer is extremely stable due, it is believed, to steric hindrance. Consequently, the yield of derivatized hydrocarbon or polymer obtainable therefrom will vary depending on the ease with which a derivatizing compound can displace the leaving group of the functionalized hydrocarbon or polymer. The yield of derivatized hydrocarbon or polymer can be significantly enhanced by controlling the acidity of the leaving group, e.g., the alcohol derived portion of the ester functionalized polymer. Thus, while any acidity which is effective to enable the leaving group —$YR^3$ of Formula (I) to be displaced during derivatization can be employed, it is contemplated that such effective acidities, expressed as the pKa of the compound $HYR^3$, be typically not greater than about 12, preferably not greater than about 10, and most preferably not greater than about 8, which pKa values can range typically from about 5 to about 12, preferably from about 6 to about 10, and most preferably from about 6 to about 8.

While the functionalized hydrocarbon or polymers themselves possess some dispersant characteristics and can be used as dispersant additives in lubricants and fuels, best results are achieved when a substantial proportion of the functional groups are derivatized; in other words when at least about 80, preferably, at least about 90, most preferably at least about 95%, for example, greater than about 98% and ideally greater than about 99%, of the functional groups are derivatized. Furthermore, it is not necessary that all the functional groups of the functionalized hydrocarbon or polymer be derivatized to the same product or even the same type of product. Thus, functionalized hydrocarbon or polymer may be first reacted with one or more alcohols to convert a portion of acid functional groups to ester groups and thereafter this ester product can be reacted with one or more amines and/or one or more metal reactants to convert all or a portion of the remaining carboxyl functions to a derivatized amine groups such as amides, imides, amidines, amine salt groups, and the like or metal salt groups.

The most preferred alcohol trapping agents may be obtained by substituting a phenol with at least one electron withdrawing substituent such that the substituted phenol possesses a pKa within the above described preferred pKa ranges. In addition, phenol may also be substituted with at least one non-electron withdrawing substituent (e.g., electron donating), preferably at positions meta to the electron withdrawing substituent to block undesired alkylation of the phenol by the polymer during the Koch reaction. This further improves yield to desired ester functionalized polymer.

Accordingly, and in view of the above, the most preferred trapping agents are phenolic and substituted phenolic compounds represented by the formula:

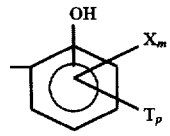

(V)

wherein X, which may be the same or different, is an electron withdrawing substituent, and T which may be the same or different is a non-electron withdrawing group; m and p are from 0 to 5 with the sum of m and p being from 0 to 5, and m is preferably from 1 to 5, and more preferably, m is 1 or 2. X is preferably a group selected from halogen, cyano, and nitro, preferably located at the 2- and/or 4-position, and T is a group selected from hydrocarbyl, and hydroxy groups and p is 1 or 2 with T preferably being located at the 4 and/or 6 position. More preferably X is selected from Cl, F, Br, cyano or nitro groups and m is preferably from 1 to 5, more preferably from 1 to 3, yet more preferably 1 to 2, and most preferably 2 located at the 2 and 4 locations relative to —OH.

The relative amounts of reactants and catalyst, and the conditions controlled in a manner sufficient to functionalize typically at least about 40, preferably at least about 80, more preferably at least about 90 and most preferably at least about 95 mole % of the carbon—carbon double bonds initially present in the unfunctionalized hydrocarbon.

The amount of alcohol or thiol used is preferably at least the stoichiometric amount required to react with the acylium cations. It is preferred to use an excess of alcohol over the stoichiometric amount. The alcohol performs the dual role of reactant and diluent for the reaction. However, the amount of the alcohol used should be sufficient to provide the desired yield yet at the same time not dilute the acid catalyst so as to adversely affect the Hammett Scale Value acidity.

The hydrocarbon or polymer added to the reactant system is typically in a liquid phase. Optionally, the hydrocarbon or polymer can be dissolved in an inert solvent. The yield can be determined upon completion of the reaction by separating polymer molecules which contain acyl groups which are polar and hence can easily be separated from unreacted non-polar compounds. Separation can be performed using absorption techniques which are known in the art. The amount of initial carbon-carbon double bonds and carbon-carbon double bonds remaining after the reaction can be determined by $C^{13}$ NMR techniques.

In accordance with the process, the hydrocarbon or polymer is heated to a desired temperature range which is typically between −20° C. to 200° C., preferably from 0° C. to 80° C. and more preferably from 40° C. to 65° C. Temperature can be controlled by heating and cooling means applied to the reactor. Since the reaction is exothermic usually cooling means are required. Mixing is conducted throughout the reaction to assure a uniform reaction medium. The reaction can be carried out in a batch reactor or, preferably, in a continuous reactor, e.g., a continuous stirred tank reactor (CSTR), or most preferably, a tubular reactor.

The catalyst (and nucleophilic trapping agent) can be prereacted to form a catalyst complex or are charged separately in one step to the reactor to form the catalyst complex in situ at a desired temperature and pressure, preferably under nitrogen. In a preferred system the nucleophilic trapping agent is a substituted phenol used in combination with $BF_3$. The reactor contents are continuously mixed and then rapidly brought to a desired operating pressure using a high pressure carbon monoxide source. Useful pressures can be up to 138000 kPa (20,000 psig), and typically will be at least 2070 kPa (300 psig), preferably at least 5520 kPa (800 psig), and most preferably at least 6900 kPa (1,000 psig), and typically will range from 3450 to 34500 kPa (500 to 5,000 psig) preferably from 4485 to 20700 kPa (650 to 3,000 psig) and most preferably from 4485 to 13800 kPa (650 to 2000 psig). The carbon monoxide pressure may be reduced by adding a catalyst such as a copper compound. The catalyst to hydrocarbon volume ratio can range from 0.25 to 4, preferably 0.5 to 2 and most preferably 0.75 to 1.3.

Preferably, the hydrocarbon or low molecular weight polymer, catalyst, nucleophilic trapping agent and CO are fed to the reactor in a single step. The reactor contents are then held for a desired amount of time under the pressure of the carbon monoxide. The reaction time can range up to 5 hours and typically 0.5 to 4 and more typically from 1 to 2 hours. The reactor contents can then be discharged and the product which is a Koch functionalized hydrocarbon comprising either a carboxylic acid or carboxylic ester or thiol ester functional groups separated. Upon discharge, any unreacted CO can be vented off. Nitrogen can be used to flush the reactor and the vessel to receive the hydrocarbon. Suitable adjustments can be made by those skilled in the art to conduct the process in a continuous manner.

Depending on the particular reactants employed, the functionalized hydrocarbon containing reaction mixture may be a single phase, a combination of a partitionable hydrocarbon or polymer and acid phase or an emulsion with either the hydrocarbon (polymer) phase or acid phase being the continuous phase. Upon completion of the reaction, the hydrocarbon is recovered by suitable means.

When the mixture is an emulsion, a suitable means can be used to separate the hydrocarbon or polymer. A preferred means is the use of fluoride salts, such as sodium or ammonium fluoride in combination with an alcohol such as butanol or methanol to neutralize the catalyst and phase separate the reaction complex. The fluoride ion helps trap the $BF_3$ complexed to the functionalized hydrocarbon and helps break emulsions generated when the crude product is washed with water. Alcohols such as methanol and butanol and commercial demulsifiers also help to break emulsions especially in combination with fluoride ions. Preferably, nucleophilic trapping agent is combined with the fluoride salt and alcohols when used to separate hydrocarbons, particularly polymers. The presence of the nucleophilic trapping agent as a solvent minimizes transesterification of the functionalized hydrocarbon.

Where the nucleophilic trapping agent has a pKa of less than 12 the functionalized hydrocarbon can be separated from the nucleophilic trapping agent and catalyst by depressurization and distillation. It has been found that where the nucleophilic trapping agent has a lower pKa, the catalyst, e.g., $BF_3$, releases more easily from the reaction mixture.

As indicated above, hydrocarbon which has undergone the Koch reaction is also referred to herein as functionalized hydrocarbon. Thus, a functionalized hydrocarbon or polymer comprises molecules which have been chemically modified by at least one functional group so that the functionalized hydrocarbon is (a) capable of undergoing further chemical reaction (e.g. derivatization) or (b) has desirable properties, not otherwise possessed by the hydrocarbon alone, absent such chemical modification.

It will be observed from the discussion of formula I that the functional group is characterized as being represented by the parenthetical expression

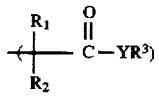

which expression contains the acyl group

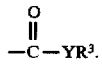

. It will be understood that while the

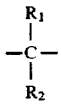

moiety is not added to the hydrocarbon or polymer in the sense of being derived from a separate reactant, it is still referred to as being part of the functional group for ease of discussion and description. Strictly speaking, it is the acyl group which constitutes the functional group, since it is this group which is added during chemical modification. Moreover, $R_1$ and $R_2$ represent groups originally present on, or constituting part of, the 2 carbons bridging the double bond before functionalization. However, $R_1$ and $R_2$ were included within the parenthetical so that neo acyl groups could be differentiated from iso acyl groups in the formula depending on the identity of $R_1$ and $R_2$.

Typically, where the end use of the hydrocarbon is for making dispersant, e.g. as derivatized hydrocarbon or polymer, the latter will possess dispersant range molecular weight (Mn).

Accordingly, while any effective functionality can be imparted to functionalized hydrocarbon intended for subsequent derivatization, it is contemplated that such functionalities, expressed as F, for dispersant end uses, are typically not greater than about 3, preferably not greater than about 2, and typically can range from about 0.5 to about 3, preferably from 0.8 to about 2.0 (e.g. 0.8 to 1).

Derivatized Polymers

The functionalized hydrocarbon or polymer can be used as a dispersant if the functional group contains the requisite polar group. The functional group can also enable the hydrocarbon to participate in a variety of chemical reactions. Derivatives of functionalized hydrocarbons can be formed through reaction of the functional group. These derivatized hydrocarbons may have the requisite properties for a variety of uses including use as dispersants. A derivatized hydrocarbon is one which has been chemically modified to perform one or more functions in a significantly improved way relative to the unfunctionalized hydrocarbon and/or the functionalized hydrocarbon. Representative of such functions, is dispersancy in lubricating oil compositions.

The derivatizing compound typically contains at least one reactive derivatizing group selected to react with the functional groups of the functionalized hydrocarbon by various reactions. Representative of such reactions are nucleophilic substitution, transesterification, salt formation, and the like. The derivatizing compound preferably also contains at least one additional group suitable for imparting the desired properties to the derivatized hydrocarbon, e.g., polar groups, at least one of the following groups: amide, imide, oxazoline, and ester, and metal salt.

The derivatized hydrocarbons or polymers include the reaction product of the above recited functionalized hydrocarbon or polymer with a nucleophilic reactant which include amines, alcohols, amino-alcohols and mixtures thereof to form oil soluble salts, amides, oxazoline, and esters. Alternatively, the functionalized hydrocarbon or polymer can be reacted with basic metal salts to form metal salts of the polymer. Preferred metals are Ca, Mg, Cu, Zn, Mo, and the like. Suitable properties sought to be imparted to the derivatized hydrocarbon include one or more of dispersancy, antioxidancy, friction modification, antiwear, antirust, seal swell, and the like.

Dispersants

Dispersants maintain insoluble materials present in oil (such insolubles, resulting from oil use), in suspension in the fluid, thus preventing sludge flocculation and precipitation. Suitable dispersants include, for example, dispersants of the ash-producing (also known as detergents) and ashless type, the latter type being preferred. The derivatized hydrocarbon compositions of the present invention, can be used as ashless dispersants in lubricant and fuel compositions.

At least one functionalized hydrocarbon is mixed with at least one of amine, alcohol, including polyol, aminoalcohol, etc., to form the dispersant additives. One class of particularly preferred dispersants are those derived from the functionalized hydrocarbon or polymer of the present invention reacted with (i) hydroxy compound, e.g., a polyhydric alcohol or polyhydroxy-substituted aliphatic primary amine such as pentaerythritol or trismethylolaminomethane (ii) polyoxyalkylene polyamine, e.g. polyoxypropylene diamine, and/or (iii) polyalkylene polyamine, e.g., polyethylene polyamine such as tetraethylene pentamine referred to herein as TEPA.

Derivatization by Amine Compounds

Useful amine compounds for derivatizing functionalized hydrocarbon and polymers comprise at least one amine and can comprise one or more additional amine or other reactive or polar groups. Where the functional group is a carboxylic acid, carboxylic ester or thiol ester, it reacts with the amine to form an amide. Preferred amines are aliphatic saturated amines. Non-limiting examples of suitable amine compounds include: 1,2-diaminoethane; 1,3-diaminopropane; 1,4-diaminobutane; 1,6-diaminohexane; polyethylene amines such as diethylene triamine; triethylene tetramine; tetraethylene pentamine; etc. Other useful amine compounds include: alicyclic diamines such as 1,4-di(aminomethyl) cyclohexane, and heterocyclic nitrogen compounds such as imidazolines. Mixtures of amine compounds may advantageously be used. Useful amines also include polyoxyalkylene polyamines. A particularly useful class of amines are the polyamido and related amines.

Derivatization by Alcohols

The functionalized hydrocarbons and polymers of the present invention can be reacted with alcohols, e.g. to form esters. The alcohols may be aliphatic compounds such as monohydric and polyhydric alcohols or aromatic compounds such as phenols and naphthols. The aromatic hydroxy compounds from which the esters may be derived are illustrated by the following specific examples: phenol, beta-naphthol, alpha-naphthol, cresol, resorcinol, catechol, etc. Phenol and alkylated phenols having up to three alkyl substituents are preferred. The alcohols from which the esters may be derived preferably contain up to about 40 aliphatic carbon atoms. They may be monohydric alcohols such as methanol, ethanol, isooctanol, etc. A useful class of polyhydric alcohols are those having at least three hydroxy radicals, some of which have been esterified with a monocarboxylic acid having from about 8 to about 30 carbon atoms, such as octanoic acid, oleic acid, stearic acid, linoleic acid, dodecanoic acid, or tall oil acid.

The esters may also be derived from unsaturated alcohols such as allyl alcohol, cinnamyl alcohol, propargyl alcohol. Still another class of the alcohols capable of yielding the esters of this invention comprise the ether-alcohols and amino-alcohols including, for example, the oxyalkylene-, oxyarylene-, amino-alkylene-, and amino-arylene-substituted alcohols having one or more oxyalkylene, amino-alkylene or amino-arylene oxyarylene radicals. They are exemplified by Cellosolve, carbitol, phenoxyethanol, etc.

The functionalized hydrocarbon or polymer of this invention is reacted with the alcohols according to conventional esterification, or transesterification techniques. This normally involves heating the functionalized hydrocarbon or polymer with the alcohol, optionally in the presence of a normally liquid, substantially inert, organic liquid solvent/diluent and/or in the presence of esterification catalyst.

Derivatization by Reactive Metals/Metal Compounds

Useful reactive metals or reactive metal compounds are those which will form metal salts of the functionalized hydrocarbon and polymer or metal-containing complexes therewith. Metal complexes are typically achieved by reacting the functionalized hydrocarbons and polymers with amines and/or alcohols as discussed above and also with complex forming reactants either during or subsequent to amination. Complex-forming metal reactants include the nitrates, nitrites, halides, carboxylates, etc.

The appropriate functionalized hydrocarbon or polymer of this invention can be reacted with any individual derivatizing compound such as amine, alcohol, reactive metal, reactive metal compound or any combination of two or more of any of these; that is, for example, one or more amines, one or more alcohols, one or more reactive metals or reactive metal compounds, or a mixture of any of these. Substantially inert organic liquid diluents may be used to facilitate mixing, temperature control, and handling of the reaction mixture.

The reaction products produced by reacting functionalized hydrocarbons and polymers of this invention with derivatizing compounds such as alcohols, nitrogen-containing reactants, metal reactants, and the like will, in fact, be mixtures of various reaction products. The functionalized hydrocarbons and, in particular, the functionalized polymers themselves can be mixtures of materials. While the functionalized hydrocarbons and polymers themselves possess some dispersant characteristics and can be used as dispersant additives in lubricants and fuels, best results are achieved when a substantial proportion of the functional groups are derivatized; in other words when at least about 80, preferably, at least about 90, most preferably at least about 95%, for example, greater than about 98% and ideally greater than about 99%, of the functional groups are derivatized. Furthermore, it is not necessary that all the functional groups of the functionalized hydrocarbon be derivatized to the same product or even the same type of product. Thus, functionalized hydrocarbon or polymer may be first reacted with one or more alcohols to convert a portion of acid functional groups to ester groups and thereafter this ester product can be reacted with one or more amines and/or one or more metal reactants to convert all or a portion of the remaining carboxyl functions to a derivatized amine groups such as amides, imides, amidines, amine salt groups, and the like or metal salt groups.

Post Treatment

Functionalized and/or derivatized hydrocarbons of the present invention may be post-treated. The processes for post-treating derivatized product are analogous to the post-treating processes used with respect to conventional dispersants of the prior art. Accordingly, the same reaction conditions, ratio of reactants and the like can be used. Accordingly, derivatized product herein can be post-treated with such reagents as urea, thiourea, carbon disulfide, aldehydes, ketones, carboxylic acids, hydrocarbon-substituted succinic anhydrides, nitriles, epoxides, boron compounds, phosphorus compounds or the like.

The amine derivatized hydrocarbons polymers of the present invention as described above can be post-treated, particularly for use as dispersants and viscosity index improvers by contacting said polymers with one or more post-treating reagents such as boron compounds, nitrogen compounds, phosphorus compounds, oxygen compounds, succinic acids and anhydrides (e.g., succinic anhydride, dodecyl succinic anhydride, and $C_1$ to $C_{30}$ hydrocarbyl substituted succinic anhydride), other acids and anhydrides such as maleic and fumaric acids and anhydrides, and esters of the foregoing e.g., methyl maleate. The amine derivatized hydrocarbons and polymers are preferably treated with boron oxide, boron halides, boron acid esters or boron ester in an amount to provide from 0.1–20.0 atomic proportions of boron per mole of nitrogen composition. Borated derivatized hydrocarbons or polymers useful as dispersants can contain from 0.05 to 2.0 wt. %, e.g. 0.05 to 0.7 wt. % boron based on the total weight of said borated nitrogen-containing dispersant compound. Treating is readily carried out by adding said boron compound, preferably boric acid usually as a slurry, to said nitrogen compound and heating with stirring at from about 135° C. to 190° C., e.g. 140° C. to 170° C., for from 1 to 5 hours. The derivatized hydrocarbons polymers of the present invention can also be treated with polymerizable lactones (such as epsilon-caprolactone) to form dispersant adducts.

Lubricating Compositions

The Koch functionalized hydrocarbon, in addition to acting as intermediates for dispersant manufacture, can be used as molding release agents, molding agents, metal working lubricants, point thickeners and the like. The primary utility for the products of the invention, from functionalized hydrocarbon all the way through post-treated derivatized hydrocarbon, is as additives for oleaginous compositions.

The additives of the invention may be used by incorporation into an oleaginous material such as fuels and lubricating oils. Fuels include normally liquid petroleum fuels such as middle distillates boiling from 65° C. to 430° C., including kerosene, diesel fuels, home heating fuel oil, jet fuels, etc. A concentration of the additives in the fuel is in the range of typically from 0.001 to 0.5, and preferably 0.005 to 0.15 wt. %, based on the total weight of the composition, will usually be employed.

The additives of the present invention may be used in lubricating oil compositions which employ a base oil in which the additives are dissolved or dispersed therein. Such base oils may be natural or synthetic. Base oils suitable for use in preparing the lubricating oil compositions of the present invention include those conventionally employed as crankcase lubricating oils for spark-ignited and compression-ignited internal combustion engines, such as automobile and truck engines, marine and railroad diesel engines, and the like. Advantageous results are also achieved by employing the additive mixtures of the present invention in base oils conventionally employed in and/or adapted for use as power transmitting fluids, universal tractor fluids and hydraulic fluids, heavy duty hydraulic fluids, power steering fluids and the like. Gear lubricants, industrial oils, pump oils and other lubricating oil compositions can also benefit from the incorporation therein of the additives of the present invention.

The additives of this invention can also be used in lubricants for two-cycle (two-stroke) internal combustion engines. Such engines include rotary engines (e.g., of the Wankel type) as well as those found in power lawn movers and other power operated garden equipment, power chain saws, pumps, electrical generators, marine outboard engines, snowmobiles, motorcycles, and the like (see, e.g., U.S. Pat. Nos. 4,708,809; 4,740,321; and 5,221,491; the disclosures of which are incorporated herein by reference). These additives may also be used in marine diesel two stroke engines such as are disclosed in U.S. Pat. No. 4,283,294 and U.K. Patent 1,353,034, the disclosures of which are incorporated herein by reference.

In some two-cycle engines the lubricating oil can be directly injected into the combustion chamber along with the fuel or injected into the fuel just prior to the time the fuel enters the combustion chamber. In other types of engines, the fuel and oil can be injected into the combustion chamber separately. As is well known to those skilled in the art, two-cycle engine lubricating oils are often added directly to the fuel to form a mixture of oil and fuel which is then introduced into the engine. Such lubricant-fuel blends contain per one (1) part of oil about 15 to 250 parts of fuel, typically about one (1) part oil to about 50 to 100 parts of fuel. For lubricant additive compositions utilizing polymers, a polymer molecular weight Mn>200 is preferred; more preferably Mn of about 250 to about 1500.

The fuels useful in two-cycle engines are well known to those skilled in the art and usually contain a major portion of a normally liquid fuel such as hydrocarbonaceous petroleum distillate fuel (e.g., motor gasoline as defined by ASTM Specification D-439-73). Such fuels can also contain nonhydrocarbonaceous materials such as alcohols, ethers, organonitro compounds and the like (e.g., methanol, ethanol, diethyl ether, methyl ethyl ether, nitromethane) are also within the scope of this invention as are liquid fuels derived from vegetable or mineral sources such as corn, alfalfa, shale and coal. Examples of such fuel mixtures are combinations of gasoline and ethanol, diesel fuel and ether, gasoline and nitromethane, etc. Where gasoline is used, it is preferred that a mixture of hydrocarbons having an ASTM boiling points of 60° C. at the 10% distillation point to about 205° C. at the 90% distillation point.

Natural oils include animal oils and vegetable oils (e.g., castor, lard oil) liquid petroleum oils and hydrorefined, solvent-treated or acid-treated mineral lubricating oils of the paraffinic, naphthenic and mixed paraffinic-naphthenic types. Oils of lubricating viscosity derived from coal or shale are also useful base oils.

Synthetic lubricating oils include hydrocarbon oils and halosubstituted hydrocarbon oils such as polymerized and interpolymerized olefins (e.g., polybutylenes, polypropylenes, propylene-isobutylene copolymers, chlorinated polybutylenes, etc. Alkylene oxide polymers and interpolymers and derivatives thereof where the terminal hydroxyl groups have been modified by esterification, etherification, etc., constitute another class of known synthetic lubricating oils. Another suitable class of synthetic lubricating oils comprises the esters of dicarboxylic acids. Esters useful as synthetic oils also include those made from $C_5$ to $C_{12}$ monocarboxylic acids and polyols and polyol ethers such as neopentyl glycol, etc. Silicon-based oils such as the polyalkyl-, polyaryl-, polyalkoxy-, or polyaryloxysiloxane oils and silicate oils comprise another useful class of synthetic lubricants. Unrefined, refined and rerefined oils can be used in the lubricants of the present invention.

The additives of the present invention, particularly those adapted for use as dispersants, can be incorporated into a lubricating oil in any convenient way. Thus, they can be added directly to the oil by dispersing or dissolving the same in the oil. Such blending into the additional lube oil can occur at room temperature or elevated temperatures. Alternatively the additives may be first formed into concentrates, which are in turn blended into the oil. Such dispersant concentrates will typically contain as active ingredient (A.I.), from 10 to 80 wt. %, typically 20 to 60 wt. %, and preferably from 40 to 50 wt. %, additive, (based on the concentrate weight) in base oil.

The additives of the invention may be mixed with other additives selected to perform at least one desired function. Typical of such additional additives are detergents, viscosity modifiers, wear inhibitors, oxidation inhibitors, corrosion inhibitors, friction modifiers, foam inhibitors, rust inhibitors, demulsifiers, antioxidants, lube oil flow improvers, and seal swell control agents.

Compositions, when containing these additives, typically are blended into the base oil in amounts which are effective to provide their normal attendant function. Representative effective amounts of such additives are illustrated as follows:

| Compositions | Broad (Wt. %) | Preferred (Wt. %) |
|---|---|---|
| V.I. Improver | 1–12 | 1–4 |
| Corrosion Inhibitor | 0.01–3 | 0.01–1.5 |
| Oxidation Inhibitor | 0.01–5 | 0.01–1.5 |
| Dispersant | 0.1–10 | 0.1–5 |
| Lube Oil Flow Improver | 0.01–2 | 0.01–1.5 |
| Detergents and Rust Inhibitors | 0.01–6 | 0.01–3 |
| Pour Point Depressant | 0.01–1.5 | 0.01–1.5 |
| Anti-Foaming Agents | 0.001–0.1 | 0.001–0.01 |
| Antiwear Agents | 0.001–5 | 0.001–1.5 |
| Seal Swellant | 0.1–8 | 0.1–4 |
| Friction Modifiers | 0.01–3 | 0.01–1.5 |
| Lubricating Base Oil | Balance | Balance |

When other additives are employed, it may be desirable, although not necessary, to prepare additive concentrates or packages comprising concentrated solutions or dispersions of the subject additives of this invention together with one or more of said other additives. Dissolution of the additive concentrate into the lubricating oil may be facilitated by solvents and by mixing accompanied with mild heating, but this is not essential. The final formulations may employ typically 2 to 20 wt. %, e.g. about 10 wt. %, of the additive package with the remainder being base oil. All of said weight percents expressed herein (unless otherwise indicated) are based on active ingredient (A.I.) content of the individual additives, and the total weight of the additive package or formulation, which will include the weight of total oil or diluent.

EXAMPLES

Composition parts and percents are by weight unless otherwise indicated. All molecular weights (Mn) are number average molecular weight.

Example 1

A poly-n-butene (Mn=550) was carbonylated as described in Example 2 of U.S. patent appication Ser. No. 992,403 (filed Dec. 17, 1992). The product carboxylic acid (TAN=80) was reacted with tetraethylenepentamine (TEPA) with a weight ratio of 6.4 parts of acid per part of TEPA and heated for 5 hours at 240° C. while water was vented off. The product, obtained in 45% yield, is useful as a two-cycle dispersant amide.

Example 2

An ethylene-butene copolymer of Mn=1100, prepared as in Example 1 of U.S. Pat. No. 5,229,022, was carbonylated as described in Example 4 of U.S. patent appication Ser. No.

992,690 (filed Dec. 17, 1992). The resultant neocarboxylic acid was aminated with TEPA as in Example 1 above.

Example 3

An ethylene-butene copolymer of Mn=3300, wt. % ethylene=46, was carbonylated to a 2,4-difluorophenyl (DFP) ester using the general procedure described in contemporaneously filed U.S. patent application docket no. PT-1145, entitled "Batch Koch Carbonylation Process," at 50° C. and 2000 psi total pressure with 24% 2,4-DFP, and approximately 1:1 molar ratio of $BF_3$:DFP. The resulting ester was formed in 85% yield.

Example 4

A similar procedure to that of Example 3 above was utilized to prepare a trifluoroethyl ester using 18% trifluoroethanol (TFE) and a 1.3:1 ratio of $BF_3$:TFE. The resulting ester was formed in about 85% yield.

Example 5

The procedure of Example 3 above was followed to prepare a hexafluoroisopropyl ester using 28% hexafluoroisopropanol (HFIP) and a 1.2:1 ratio of $BF_3$:CO:HFIP. The yield was about 81%.

Example 6

The procedure of Example 3 above was followed to prepare a pentaflurophenyl ester using 28% pentafluorophenol (PFP) and a ratio of $BF_3$:PFP of 1.2:1. The yield was about 81%.

Example 7

The procedure of Example 3 above was followed to prepare a dichlorophenyl ester using 27% dichlorophenol (DCP) and a ratio of $BF_3$:DCP of 1.2:1. The yield was about 83%.

Examples 8–12

The esters of Examples 3–7 above were reacted with TEPA as shown in the accompanying table; the reaction was followed using the infrared absorption of the carbonyl peak (1740–1770 cm-1), and was continued until the peak had substantially disappeared, in order to yield the dispersant amide.

| Example | Ester | Equiv. ester/Equiv. amine | Temp (°C.) |
|---|---|---|---|
| 8 | Ex 3 | 0.4 | 200 |
| 9 | Ex 4 | 0.05 | 240 |
| 10 | Ex 5 | .02 | 220 |
| 11 | Ex 6 | 0.6 | 150 |
| 12 | Ex 7 | 0.2 | 180 |

Simple alpha-olefins can also be used to prepare esters via Koch reaction that are more reactive than simple acids towards derivatization with amine to prepare dispersants. This is illustrated below:

Example 13

A linear $C_{18}$ terminally substituted olefin was carbonylated to give a 2,4-dichlorophenylenyl ester using the general carbonylation procedure of Example 3 above at 60° C. and 1500 psi with 39% dichlorophenol (DCP) and a 2:1 molar ratio of $BF_3$:DCP. The yield was about 71%.

The ester can be converted to a dispersant as described in Examples 8–12 above. Blends of the above acids or esters with more conventional acids such as isostearic acid, polyisobutylene (PIB) carboxylic acid or polyisobutylene succinic anhydride (PIBSA) are also suitable for this invention.

For substantially linear $C_{14}$–$C_{24}$ alpha-olefins, disubstituted, vinylidene olefins are preferred. Esters with leaving groups that have pKa values in water less than 12 are also preferred. For polymeric compositions, Mn>200 is preferred, more preferably 250–1500.

We claim:

1. A derivatized hydrocarbon lubricating oil dispersant which is the product of reacting (1) a functionalized olefin other than gem.-structured polyolefin hydrocarbon of less than 500 Mn wherein functionalization comprises at least one group of the formula —CO—Y—$R^3$ wherein Y is O or S; $R^3$ is H, hydrocarbyl, aryl, substituted aryl or substituted hydrocarbyl and wherein at least 50 mole % of said functional groups are attached to a tertiary carbon atom; and (2) a nucleophilic reactant; wherein at least about 50% of said functional groups originally present in said functionalized hydrocarbon are derivatized, and further provided that the functionalized olefin is prepared by a process comprising the step of reacting an olefin, carbon monoxide, an acid catalyst having a Hammett acidity of less than −7, and a nucleophilic trapping agent selected from the group consisting of hydroxy-containing compounds and thiol-containing compounds having a pKa of less than 12, the reaction being conducted in the absence of reliance on transition metal as a catalyst.

2. A lubricant composition suitable for use in two-cycle engines comprising a major amount of at least one oil of lubricating viscosity and a minor amount of a functionalized and derivatized hydrocarbon; dispersant of claim 1.

3. The two-cycle lubricant composition of claim 2 wherein said nucleophilic reactant is selected from the group consisting of alcohols and amines.

4. A lubricant-fuel mixture suitable for use in two-cycle engines wherein said lubricant comprises the composition of claim 2.

5. The lubricant-fuel mixture of claim 4 wherein said nucleophilic reactant is selected from the group consisting of alcohols and amines, and wherein at least 80% of said functional groups are attached to a tertiary carbon atom.

6. The lubricant-fuel mixture of claim 4 wherein the fuel is selected from the group consisting of hydrocarbonaceous petroleum distillates and liquid fuels derived from vegetable or mineral sources, wherein such fuel optionally contains nonhydrocarbonaceous materials compatible therewith.

7. The composition of claim 2 wherein at least about 80% of said functional groups originally present in said functionalized hydrocarbon are derivatized.

* * * * *